US007168986B1

(12) United States Patent
Peng

(10) Patent No.: US 7,168,986 B1
(45) Date of Patent: Jan. 30, 2007

(54) BOARD-TO-BOARD CONNECTOR ASSEMBLY WITH EMI SHIELDING SHIELDS

(75) Inventor: Yung Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/384,783

(22) Filed: Mar. 21, 2006

(51) Int. Cl.
*H01R 13/648* (2006.01)

(52) U.S. Cl. ..... 439/607

(58) Field of Classification Search ..... 439/607, 439/608, 609, 939
See application file for complete search history.

(56) References Cited

U.S. PATENT DOCUMENTS 5,256,085 A * 10/1993 Tan et al. ..... 439/607
5,599,207 A * 2/1997 Lai ..... 439/567
6,042,398 A * 3/2000 Wu et al. ..... 439/101
6,093,058 A * 7/2000 Wu ..... 439/607
6,183,294 B1 * 2/2001 Fan et al. ..... 439/567

* cited by examiner

*Primary Examiner*—Phuong Dinh
(74) *Attorney, Agent, or Firm*—Rosenberg, Klein & Lee

(57) ABSTRACT

A board-to-board connector assembly with function of EMI shielding shields includes a receptacle connector and a plug connector. The receptacle connector includes a receptacle housing and a first shielding shell fixed to and encircling the receptacle housing. The plug connector includes a plug housing and a pair of second shielding shells respectively having a base plate and a pair of arms extending vertically from two ends of the base plate for hugging the two opposite end portions of the plug housing. The base plate contacts the elastic arms of the first shielding shell. At least one of the first and second shielding shells has a grounding means for soldering to a corresponding printed circuit board.

13 Claims, 6 Drawing Sheets

BOARD-TO-BOARD CONNECTOR ASSEMBLY WITH EMI SHIELDING SHIELDS

BACKGROUND OF THE INVENTION

1. Field of the Invention

The present invention relates to a board-to-board connector assembly, and more particularly to a board-to-board connector assembly with EMI (Electromagnetic Interference; EMI) shielding shields.

2. The Related Art

Generally, a board-to-board connector assembly is mounted in an electronic device for electrically interconnecting with a pair of spaced parallel printed circuit boards. The conventional board-to-board connector assembly is mainly used to transmit low frequency signals or low speed signals. However, along with the increasing function of the electronic device, the board-to-board connector assembly is required to transmit some high frequency signals or high speed signals, thus some electromagnetic interference signals are inevitably produced.

U.S. Pat. No. 6,305,982 disclosed a board-to-board connector assembly that includes a receptacle connector mounted to one printed circuit board and a plug connector mounted to another printed circuit board. The receptacle connector includes a receptacle housing, a plurality of first contacts received in the receptacle housing, and a pair of metal shields fixed to and encircling the two opposite faces of the receptacle housing. The plug connector includes a plug housing, a plurality of second contacts received in the plug housing, and a pair of solder pads fixed to the plug housing.

In use, the first contacts and the second contacts are respectively soldered to the corresponding printed circuit boards to interconnect with the two printed circuit boards. The metal shields contact the solder pads and are soldered to a grounding circuit of the corresponding printed circuit board. The solder pads are soldered to a grounding circuit of another printed circuit board. When the board-to-board connector assembly transmits high frequency signals or high-speed signals, electromagnetic interference signals are transmitted into the printed circuit boards.

However, only the receptacle connector has a pair of metal shields fixed to the receptacle housing, the plug connector has no shields, which unfavorably affects the shielding effectiveness.

SUMMARY OF THE INVENTION

An object of the present invention is to provide a board-to-board connector assembly with EMI shielding shields for electrically interconnecting with a pair of spaced parallel printed circuit boards. The board-to-board connector assembly includes a receptacle connector mounted to one of the printed circuit boards and a plug connector mounted to the other printed circuit board. The receptacle connector includes a receptacle housing, a plurality of first contacts and a first shielding shell. The receptacle housing has a pair of sidewalls protruding upwardly from two opposite sides thereof, a channel defined between the two sidewalls and a plurality of first passageways longitudinally arranged along the sidewalls. The first contacts are received in the respective first passageways. The first shielding shell is fixed to and encircles the receptacle housing and has a pair of elastic arms extending upwardly from two opposite ends thereof. The plug connector includes a plug housing, a plurality of second contacts and a pair of second shielding shells. The plug housing has a base received in the channel of the receptacle connector, two opposite end portions extending horizontally and outwardly from two opposite ends of the base, and a plurality of second passageways longitudinally arranged along two opposite sides of the base. The second contacts are received in the respective second passageways. The second shielding shells respectively have a base plate and a pair of arms bending and extending perpendicularly from two ends of the base plate for hugging the two opposite end portions of the plug housing. The base plate contacts the elastic arms of the first shielding shell. At least one of the first and second shielding shells has a grounding means soldered to the corresponding printed circuit board. Therefore, when the board-to-board connector assembly transmits high frequency signals or high-speed signals, electromagnetic interference signals are completely transmitted into the printed circuit boards. Thus a good electromagnetic shielding effectiveness is acquired, and in turn, a credible signal transmission between the two printed circuit boards is realized.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
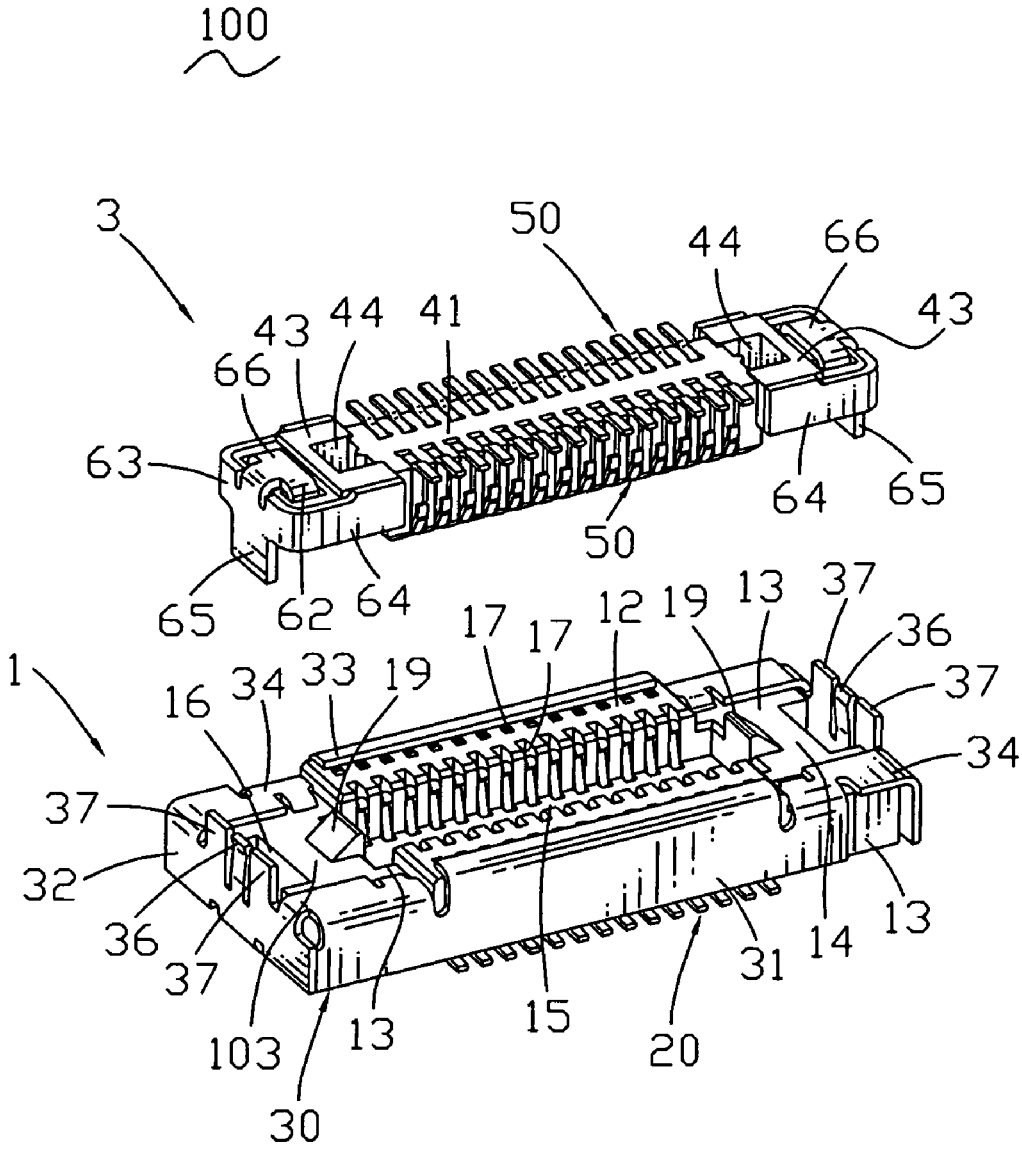
FIG. 1 is an exploded perspective view of a board-to-board connector assembly with EMI shielding shields in accordance with the present invention.

With reference to FIG. 1, a board-to-board connector assembly 100 with EMI shielding shields in accordance with the present invention is used to electrically interconnect with a pair of spaced parallel printed circuit boards (not shown). The board-to-board connector assembly 100 with EMI shielding shields includes a receptacle connector 1 mounted to one of the printed circuit boards and a plug connector 3 mounted to the other printed circuit board.

Figure 2:
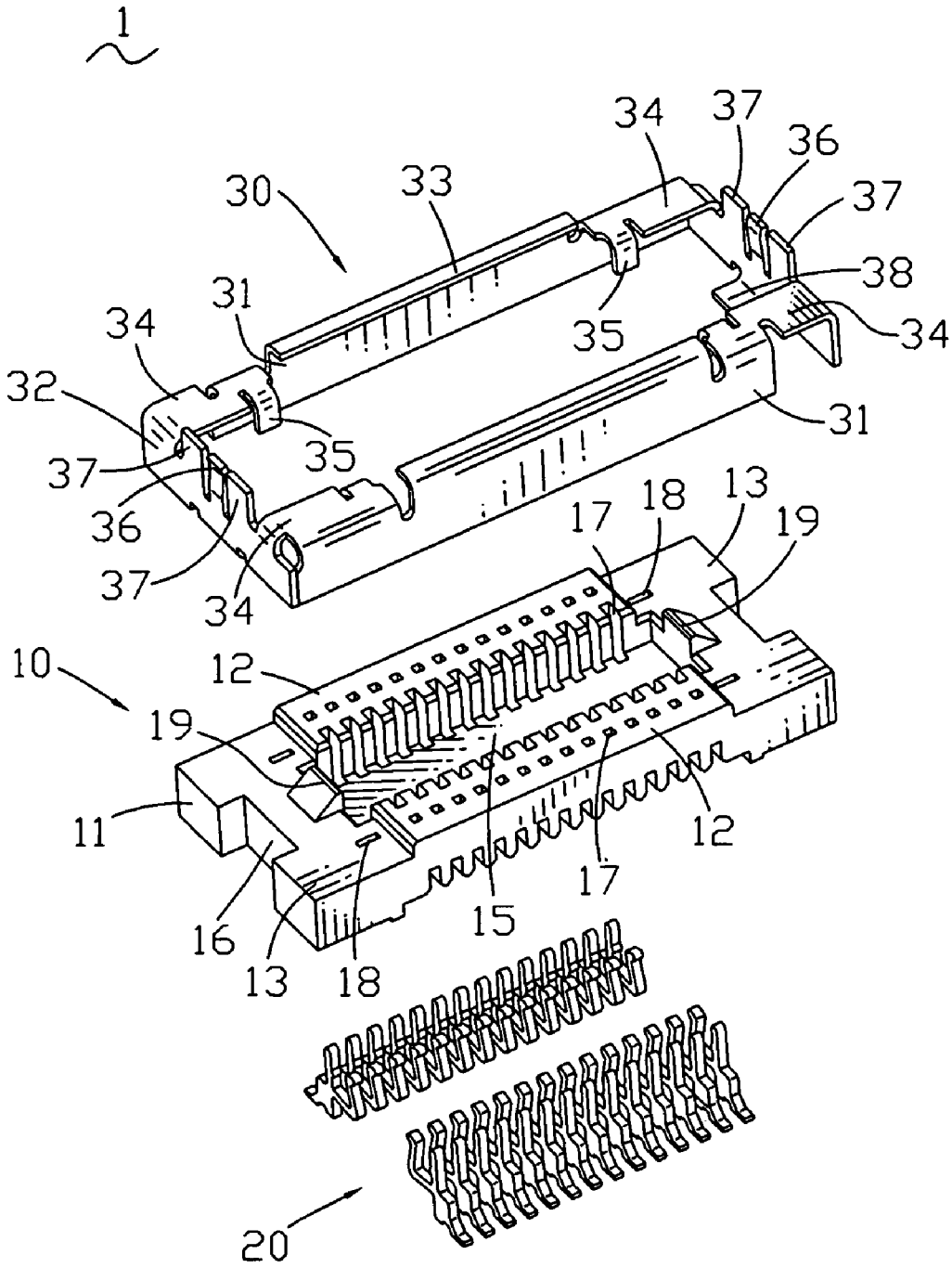
FIG. 2 is an exploded perspective view of a receptacle connector of the board-to-board connector assembly with EMI shielding shields as shown in FIG. 1.

Referring to FIG. 2, the receptacle connector 1 has a receptacle housing 10, a plurality of first contacts 20 arranged in two parallel rows and received in the receptacle housing 10, and a first shielding shell 30 fixed to and encircling the receptacle housing 10.

The receptacle housing 10 includes a flat bottom plate 11, a pair of sidewalls 12 extending along the longitudinal direction and protruding upwardly from two opposite sides of the bottom plate 11, and a pair of endwall portions 13 protruding upwardly from two opposite ends of the bottom plate 11. The endwall portions 13 are lower than the sidewalls 12. A channel 15 is formed between the sidewalls 12. Each sidewall 12 has a plurality of first passageways 17 arranged in a same spacing defined therein. The first passageways 17 penetrate through the bottom plate 11 and the sidewall 12 and communicate with the channel 15. The endwall portions 13 respectively have a gap 16 defined from top to bottom at the middle of outer end thereof and a pair of first holes 18 defined from top to bottom at two opposite sides thereof. The first holes 18 are located adjacent to the sidewalls 12. The endwall portion 13 further has a wedged tenon 19 bordering the channel 15 and protruding upwardly from the middle of top surface thereof.

The first shielding shell 30 includes a pair of spaced-apart parallel side plates 31, a pair of parallel end plates 32, wherein the side plates and the end plates respectively connect with each other with each end thereof, and a cover 34 which is disposed at the top of a connecting place of the side plate 31 and the end plate 32. A clipping arm 33 is formed by extending from the side plate 31 and then perpendicularly bent to extend inwardly. The clipping arm 33 extends along the longitudinal direction of the side plate 31. The end plate 32 has an elastic arm 36 extending uprightly upwardly from the middle of top thereof. A pair of first contact plates 37 respectively extending uprightly upwardly at two sides of the elastic arm 36. A grounding means located on the first shielding shell 30 has a first grounding nail 38 formed by bending horizontally and inwardly from the bottom of the end plate 32 of the first shielding shell 30 and is soldered to the corresponding printed circuit board. Each of the covers 34 laterally extends and then bends downwardly to form a claw 35 adjacent to the clipping arm 33.

Figure 3:
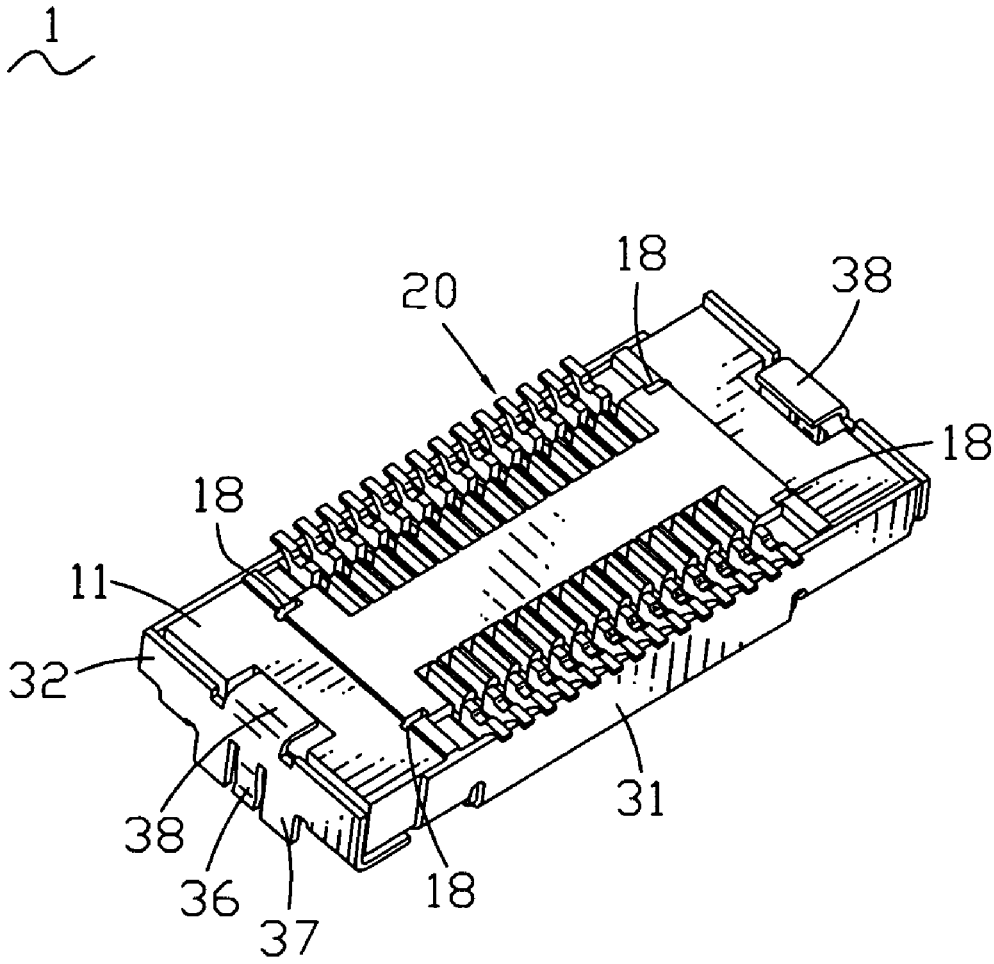
FIG. 3 is a perspective view of the receptacle connector.

Referring to FIG. 1 to FIG. 3, in assembly, each first contact 20 is received in the respective first passageway 17 of the receptacle housing 10. The first shielding shell 30 is fixed to and encircles the receptacle housing 10. The side plate 31 of the first shielding shell 30 is fixed to and covers outer surfaces of the sidewall 12 and the endwall portions 13. The end plate 32 of the first shielding shell 30 is fixed to and covers outer end surface of the endwall portions 13. The covers 34 are fixed to and cover two opposite sides of top surface of the endwall portion 13. The clipping arm 33 of the first shielding shell 30 clips top surface of the sidewall 12. The elastic arm 36 and the first contact plate 37 face the gap 16. The claw 35 is fixed into the first hole 18 of the endwall portions 13. After assembly, a hold zone 103 is formed between the two covers 34.

Figure 4:
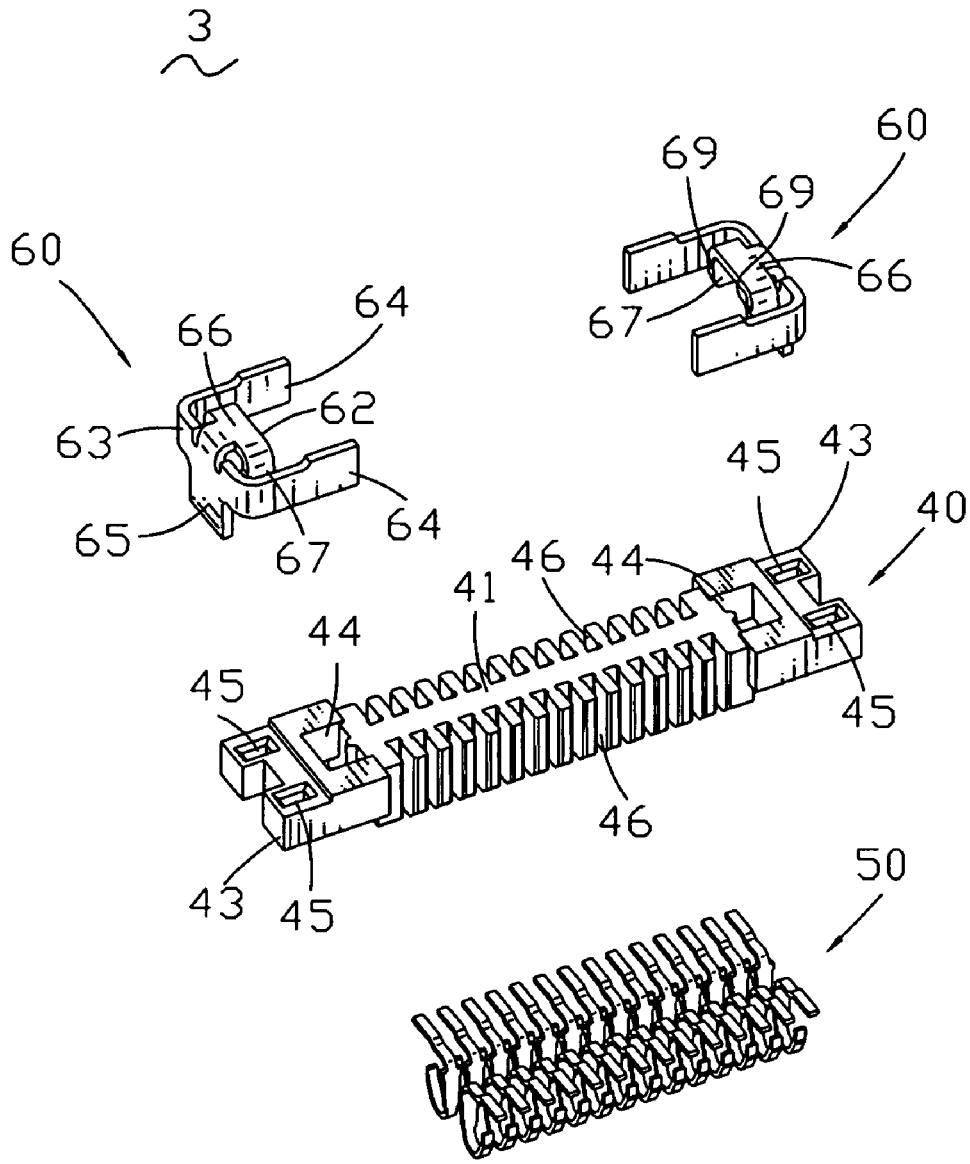
FIG. 4 is an exploded perspective view of a plug connector of the board-to-board connector assembly with EMI shielding shields as shown in FIG. 1.

With reference to FIG. 4, the plug connector 3 has a plug housing 40, a plurality of second contacts 50 received in the plug housing 40, and a pair of second shielding shell 60 fixed to the plug housing 40.

The plug housing 40 includes a base 41, two opposite end portions 43 extending horizontally and outwardly from two opposite ends of the base 41 and a plurality of second passageways 46 arranged in a same spacing defined at two opposite sides of the base 41. Each end portion 43 has a second hole 44 bordering the base 41 defined from top to bottom and a pair of latch cavities 45 defined from top to bottom at two opposite sides of outer top surface thereof.

Figure 5:
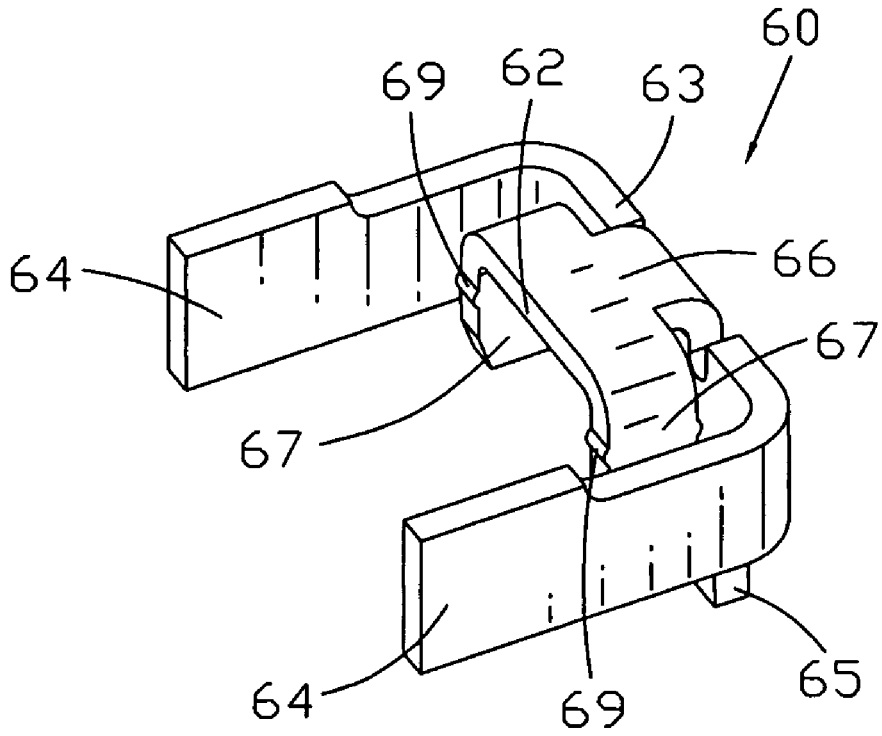
FIG. 5 is a perspective view of a second shielding shell of the plug connector.
Figure 6:
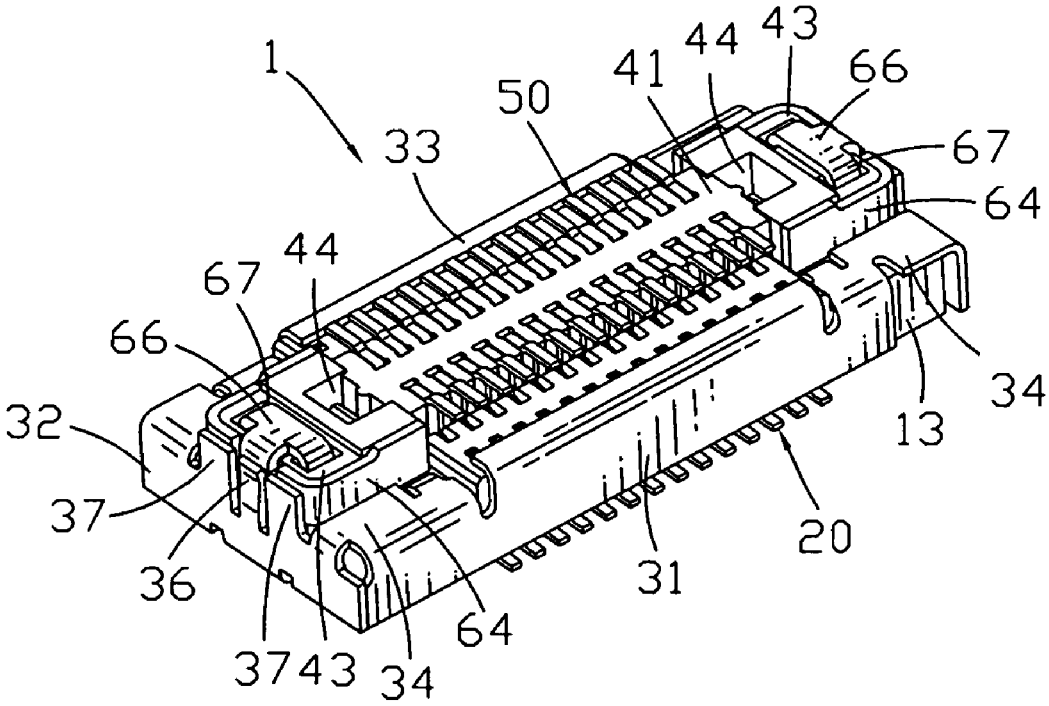
FIG. 6 is an assembled perspective view of the board-to-board connector assembly with EMI shielding shields.

The second shielding shell 60 includes a base plate 63, a pair of arms 64 extending from two ends of the base plate 63 and then perpendicularly bend to extend forward, and a leg 65 extending uprightly downwardly from the bottom of the base plate 63. Another grounding means formed on the second shielding shell 60 has a second grounding nail 66 of a level plate configuration extending horizontally towards the same direction where the arms 64 laterally extend from the middle of the base plate 63. A pair of latch arms 67 extend downwardly from two ends of the second grounding nail 66. A pair of arc protruding blocks 69 (as shown in FIG. 5) extend from the middle of two lateral sides of each latch arm 67.

Referring to FIG. 1, in assembly, each second contact 50 is received in the respective second passageway 46 of the plug housing 40. The second shielding shell 60 is fixed to and hugs the end portion 43 of the plug housing 40. The base plate 63 of the second shielding shell 60 is fixed to and covers outer end surface of the end portion 43. The arms 64 are respectively fixed to two opposite side surfaces of the end portion 43. The second grounding nail 66 is fixed to top surface of the end portion 43. Each latch arm 67 is fixed into the respective latch cavity 45. The arc protruding block 69 props the inner surface of latch cavity 45 to enable the latch arm 67 to be fixed into the latch cavity 45 more credibly.

Referring to FIG. 1 to FIG. 6, when the plug connector 3 and the receptacle connector 1 mate with each other, the base 41 of the plug connector 3 is inserted into the channel 15 of the receptacle connector 1. The end portion 43 with the second shielding shell 60 of the plug connector 3 is held in the hold zone 103 of the receptacle connector 43. The tenon 19 of the receptacle connector 1 is fixed into the second hole 44 of the plug connector 3. Thus the receptacle connector 1 and the plug connector 3 are fixedly combined. Meanwhile, the first contacts 20 steadily contact the respective second contacts 50. In the process of the plug connector 3 inserted into the receptacle connector 1, the leg 65 of the second shielding shell 60 extends downwardly against inner of the elastic arm 36 of the first shielding shell 30 and simultaneously pushes the elastic arm 36 outwardly until the plug connector 3 is inserted into the receptacle connector 1 completely. Therefore, the leg 65 is located in the gap 16 and contacts the end plate 32 and the elastic arm 36. The elastic arm 36 of the first shielding shell 30 latches the base plate 63 of the second shielding shell 60 at the middle of outer surface. The inner surfaces of the first contact plates 37 contact outer surface of the base plate 63 at two sides. The end of each cover 34 of the first shielding shell 30 contacts bottom of outer surface of the arm 64. Therefore, a good electrical connection is acquired between the first shielding shell 30 and the second shielding shell 60.

In use, the receptacle connector 1 and the plug connector 3 are respectively mounted to the corresponding printed circuit boards. The first contacts 20 of the receptacle connector 1 and the second contacts 50 of the plug connector 3 are respectively soldered to the corresponding printed circuit boards in order to electrically interconnect with the spaced parallel printed circuit boards. The first grounding nail 38 of the first shielding shell 30 is soldered to the corresponding printed circuit board. The second grounding nail 66 of the second shielding shell 60 is soldered to the corresponding printed circuit board. Therefore, when the board-to-board connector assembly with EMI shielding shields 100 transmits high frequency signals or high-speed signals, electromagnetic interference signals generated thereby are completely transmitted into the printed circuit boards and grounded. Thus, a good electromagnetic shielding effectiveness is acquired, and in turn, a credible signal transmission between the printed circuit boards is realized.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A board-to-board connector assembly with EMI shielding shields for electrically interconnecting with a pair of spaced parallel printed circuit boards, comprising:

a receptacle connector mounted to one of the printed circuit boards, the receptacle connector comprising a receptacle housing having a pair of sidewalls protruding upwardly from two opposite sides thereof, a channel defined between the two sidewalls, a plurality of first passageways longitudinally arranged along the sidewalls and a plurality of first contacts received in the respective first passageways;

a first shielding shell fixed to and encircling the receptacle housing, the first shielding shell having a pair of elastic arms extending upwardly from two opposite ends thereof;

a plug connector mounted to the other printed circuit board, the plug connector comprising a plug housing having a base received in the channel of the receptacle connector, two opposite end portions extending outwardly from two opposite ends of the base, a plurality of second passageways longitudinally arranged along two opposite sides of the base and a plurality of second contacts received in the respective second passageways; and a pair of second shielding shells respectively having a base plate and a pair of arms bending and extending inwardly from two ends of the base plate for hugging the two opposite end portions of the plug housing, the base plate contacting the elastic arms of the first shielding shell;

wherein at least one of the first and second shielding shells has a grounding means soldered to the corresponding printed circuit board.

2. The board-to-board connector assembly with EMI shielding shields as claimed in claim 1, wherein the first shielding shell comprises a pair of spaced-apart side plates and a pair of end plates, wherein the side plates and the end plates respectively connect with each other with each end thereof, the side plates are fixed to and cover outer surfaces of the sidewalls of the receptacle housing, the end plates are fixed to and cover two opposite end surfaces of the receptacle housing.

3. The board-to-board connector assembly with EMI shielding shields as claimed in claim 2, wherein a clipping arm is formed by extending from the side plate and then perpendicularly bent to extend inwardly, the clipping arm clips top surface of the sidewall.

4. The board-to-board connector assembly with EMI shielding shields as claimed in claim 2, wherein the grounding means is located on the first shielding shell which has a first grounding nail formed by bending horizontally and inwardly from the bottom of the end plate of the first shielding shell for being soldered to the corresponding printed circuit board.

5. The board-to-board connector assembly with EMI shielding shields as claimed in claim 2, wherein the elastic arm extends upwardly from the middle of top of the end plate.

6. The board-to-board connector assembly with EMI shielding shields as claimed in claim 5, wherein the end plate further has a pair of first contact plates extending upwardly at two sides of the elastic arm, the two first contact plates contacting the base plate.

7. The board-to-board connector assembly with EMI shielding shields as claimed in claim 2, wherein the receptacle housing further has a pair of endwall portions lower than the sidewalls at two opposite ends thereof, two opposite ends of the side plate are fixed to outer side surfaces of the endwall portions, and the end plate is fixed to outer end surface of the endwall portion.

8. The board-to-board connector assembly with EMI shielding shields as claimed in claim 7, wherein a cover disposed at the top of a connecting place of the side plate and the end plate, the cover covers top surface of the endwall portion.

9. The board-to-board connector assembly with EMI shielding shields as claimed in claim 8, wherein each of the covers extends downwardly from edge to form a claw, the endwall portion has a first hole defined in top surface thereof corresponding to the claw, and the claw is fixed into the first hole.

10. The board-to-board connector assembly with EMI shielding shields as claimed in claim 1, wherein the grounding means is located on the second shielding shell which has a second grounding nail extending horizontally towards the same direction where the arm laterally extends from the middle of the base plate.

11. The board-to-board connector assembly with EMI shielding shields as claimed in claim 10, wherein further has a pair of latch arms extending downwardly from two ends of the second ground nail, and a pair of arc protruding blocks protruding from the middle of two lateral sides of the latch arms.

12. The board-to-board connector assembly with EMI shielding shields as claimed in claim 11, wherein a pair of latch cavities are defined in a top surface of the end portion of the plug housing for insertion of the latch arm.

13. The board-to-board connector assembly with EMI shielding shields as claimed in claim 1, wherein the second shielding shell further has a leg extending downwardly from the base plate to contact the elastic arm of the first shielding shell.

* * * * *